US006379241B1

(12) United States Patent
Kuo

(10) Patent No.: US 6,379,241 B1
(45) Date of Patent: Apr. 30, 2002

(54) WIND-HOLE DEVICE OF A VENTILATOR FOR AN AIR CONDITIONER

(76) Inventor: Chin-Sheng Kuo, P.O. Box 90, Tainan City (TW)

( * ) Notice: Subject to any disclaimer, the term of this patent is extended or adjusted under 35 U.S.C. 154(b) by 0 days.

(21) Appl. No.: 09/714,275

(22) Filed: Nov. 17, 2000

(51) Int. Cl.[7] ..... F24F 13/06
(52) U.S. Cl. ..... 454/248
(58) Field of Search ..... 454/245, 246, 454/247, 248, 230, 233

(56) References Cited

U.S. PATENT DOCUMENTS 688,132 A * 12/1901 Sims
1,152,864 A * 9/1915 Triggs
1,177,779 A * 4/1916 Kerch
3,065,686 A * 11/1962 Geocaris
3,301,163 A * 1/1967 Raider
5,076,152 A * 12/1991 Muller et al. ..... 454/245
5,577,958 A * 11/1996 Kumekawa et al. ..... 454/233
6,264,551 B1 * 7/2001 Smith ..... 454/248

* cited by examiner

*Primary Examiner*—Harold Joyce

(57) ABSTRACT

A wind-hole device of a ventilator for an air conditioner includes a face plate having wind-outlets and wind-inlets, a cover plate positioned on the wind-inlets and having vent holes, plural shells fitted respectively with the wind-outlets of the face plate, having a downward opening and a center holes formed in an center portion, and then a plurality of wind-pipe connecters respectively fitted with the vent-holes of the cover plate and the center holes of the shells for receiving wind-pipes. The wind-hole device is characterized by a space formed by the shells separated to serve as wind-exhausting chambers and wind-sucking chambers to facilitate air circulation.

3 Claims, 5 Drawing Sheets

WIND-HOLE DEVICE OF A VENTILATOR FOR AN AIR CONDITIONER

BACKGROUND OF THE INVENTION

1. Field of the Invention

This invention relates to a wind-hole device of a ventilator for an air conditioner, particularly to one including a face plate, a cover plate, plural hollow shells and wind-pipe connecters assembled together to connect with a ventilator inside a room, possible to facilitate assembly, to lower the cost and to keep the quality of air.

2. Description of the Prior Art

A conventional central air conditioning system, as shown in FIG. 1, includes an outdoor air conditioner 11 and an indoor air conditioner 12 connected to each other. The indoor air conditioner 12 is installed at a proper location such as in a space between the ceiling and a story floor, and has a plurality of guide pipes connected to wind-outlets 13; the plate faces of the wind-outlets 13 are flush with the surface of the ceiling. Besides, some wind-inlets 14 corresponding to the location of the wind-outlets 13 are fixed on the surface of the ceiling, having face plates and filtering nets to filter the exhausted air into the room.

However, such conventional device of wind-holes has the following disadvantages.

1. The wind-inlets have no guide pipes to guide the exhaust air to flow out so that hot wind produced will stay in the space within the ceiling, and then seep into the room, thus, reducing the effect of air cooling.
2. Since the wind inlets of the indoor air conditioner 12 have no function for filtering, the air sucked in by the indoor air conditioner 12 can be filtered only by the filtering net of the wind-inlets 14; as a result, the air together with the dust in the space within the ceiling will be sucked in at the same time and then exhausted into the room, not only damaging the indoor conditioner 12, but also worsening quality of the air.
3. In order to achieve an effect of exhausting air, several vent-pipes have to be provided, thus increasing the cost.
4. A plurality of wind-outlets and wind-inlets need be provided on the surface of a ceiling for connecting with an insert-style air conditioner, thus damaging the integral beauty of the ceiling.

Another kind of insert-type air conditioner able to exhaust and suck wind has been in use nowadays, as shown in FIG. 2. It includes an outdoor air conditioner 21 and an indoor air conditioner 22, the latter having wind-outlet 220 and wind-inlet 221. Besides, the insert-type air conditioner is assembled integral with the wind-outlet 220 and the wind-inlet 221 to render a visual effect of integral beauty.

However, such an insert-type air conditioner, when installed for a better effect of cooling air in a big room, needs to be provided with more than one indoor ventilator, thus increasing the cost. In addition, the face plate of wind holes is close to the ventilator 22 so that the noise caused by operation of the ventilator 22 can easily be heard through the wind-outlet 221, and besides, the ventilator 22 is so heavy that it always takes much force and time to install, repair or to clean.

SUMMARY OF THE INVENTION

The objective of the invention is to offer a wind-hole device of a ventilator for an air conditioner including a face plate, a cover plate, plural shells and a number of wind-pipe connecters assembled together, easy to be connected with an indoor ventilator, convenient to be assembled, and possible to lower the cost and to keep fine air quality.

The feature of the invention is a face plate provided with a plurality of wind-outlets and wind-inlets, a cover plate fitted on the wind-inlets of the face plate, having several vent holes, plural shells respectively fitted with the wind-outlets of the face plate, having a downward opening a center wind holes in a center portion and a plurality of wind-pipe connecters respectively connected with the vent-holes of the cover plate and with the leading wind-holes of the shells for receiving wind pipes.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
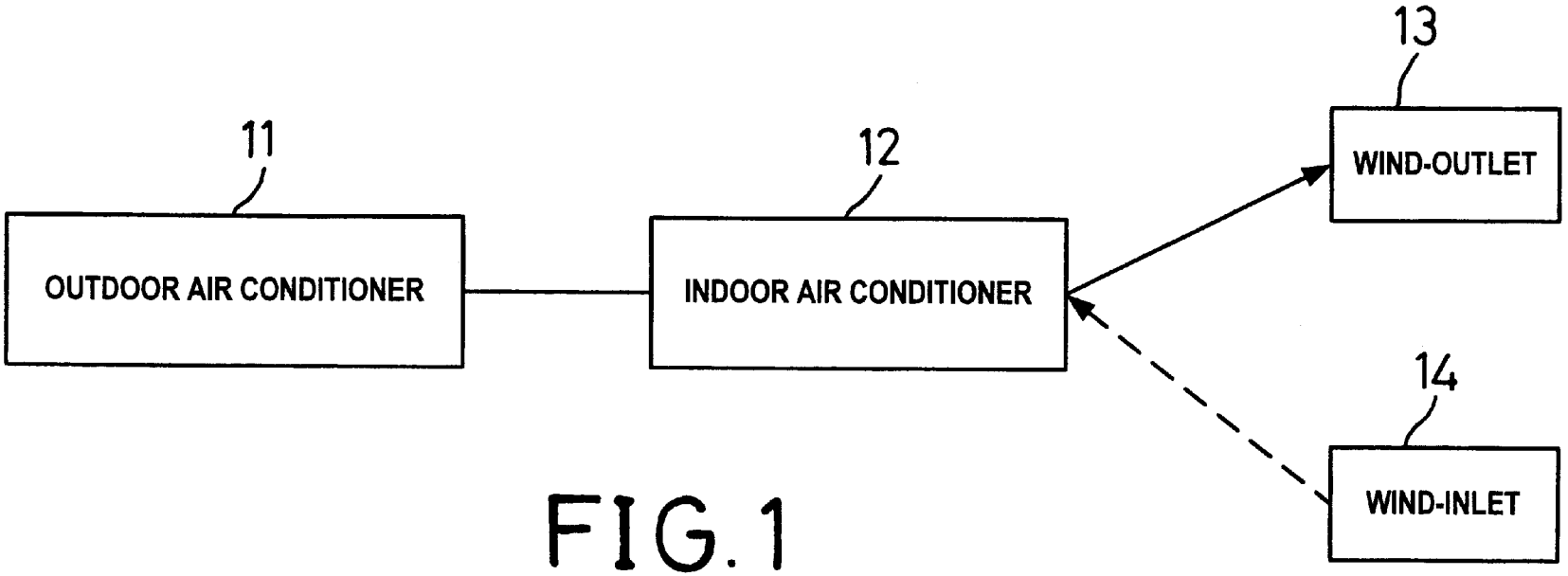
FIG. 1 (PRIOR ART)
FIG. 1 is a diagram of a conventional central air-conditioning system.
Figure 2:
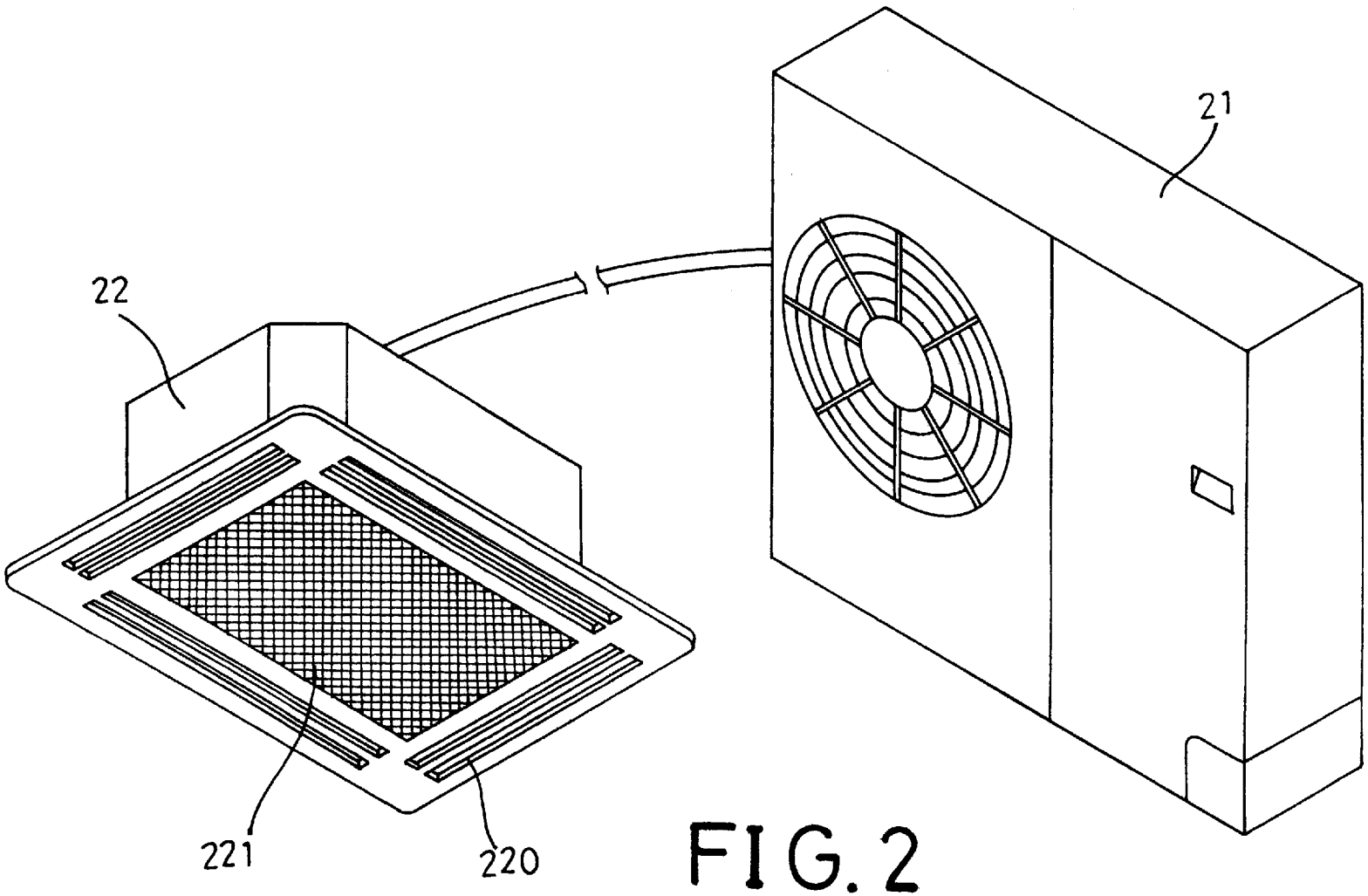
FIG. 2 (PRIOR ART)
FIG. 2 is a perspective view of a conventional insert-type ventilator for an air conditioner.
Figure 3:
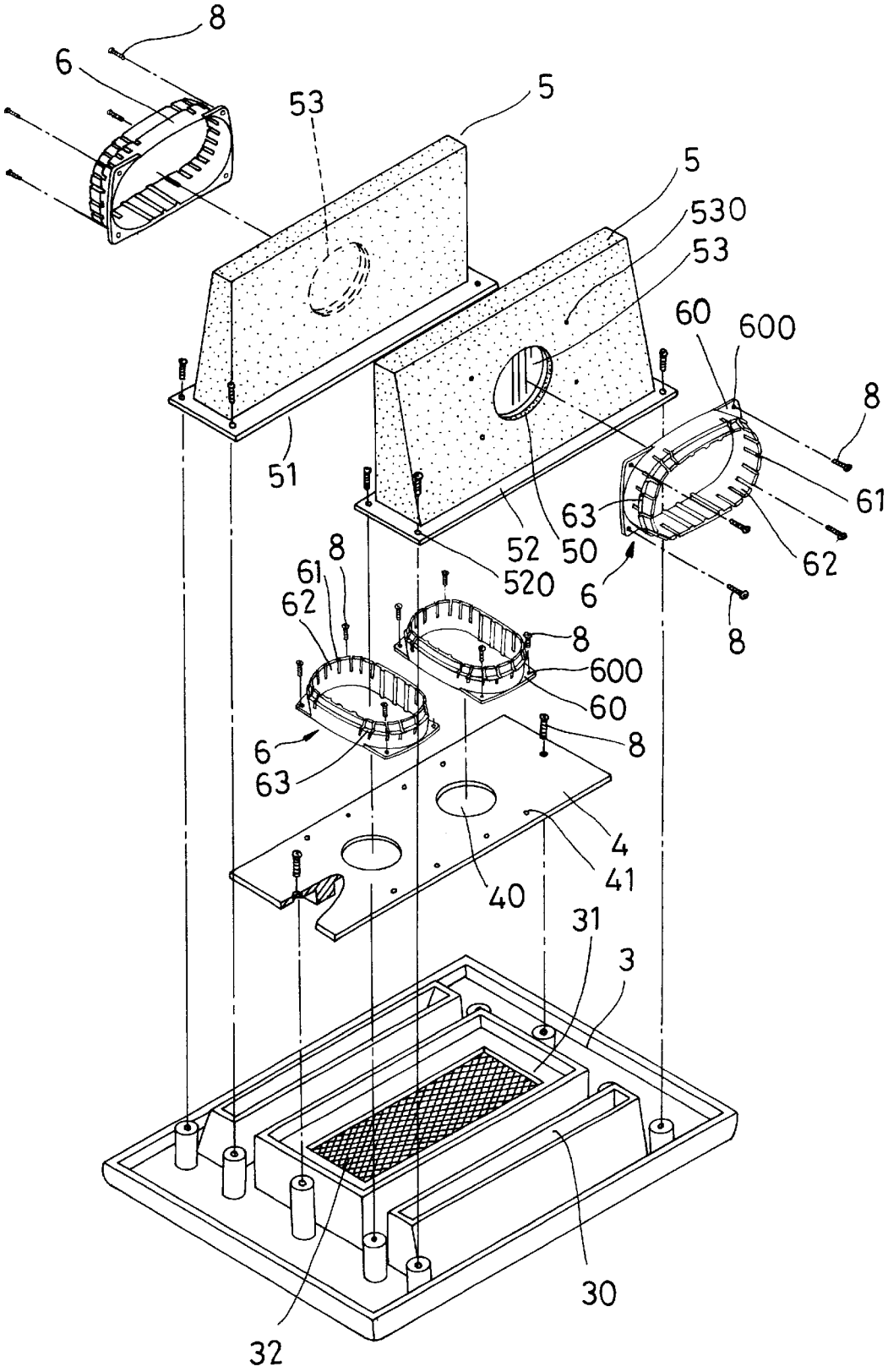
FIG. 3 is an exploded perspective view of the wind-hole device of a ventilator for an air conditioner in the present invention.

A preferred embodiment of a wind-hole device of a ventilator in the present invention, as shown in FIG. 3, includes a faceplate 3, a cover plate 4, plural shells 5 and plural windpipe connecters 6 as main components assembled together.

The faceplate 3 has two wind outlets 30 in two side, having leaves inside to adjust the direction of wind, and a wind inlet 31 in the central portion having filtering member 32.

The cover plate 4 is fitted on the topside of the recessed wind inlet 31 provided with plural vent-holes 40 and several screw holes 41 in a circumferential edge.

The shells 5 are correspondingly fitted with the protruding-up edge of the relative wind outlet 30 of the face plate 3, having a heat insulating layer 50 of certain thickness disposed inside or outside (disposed outside illustrated in FIG. 3), and a downward opening 51 with a flange 52 formed around its circumferential edge; in addition, a plurality of assembly holes 520 are bored in the flange 52, and screw holes 530 bored near the circumferential edge of a center hole 53 in the center portion of each shell 5.

The wind-pipe connecters 6 made integral of plastic material are respectively fixed with the center hole 40 of the cover plate 4 and the center hole 53 of the shells 5; then, a fix plate 60 is formed around the circumference of a lower side, having inserting holes 600 in four corners. Then, a plurality of vertical slots 61 are formed in the protruding-up wall of the wind-pipe connecters 6, and an elastic inserting members 62 is defined between every two abutting vertical slots 61, having a sloped insert lateral edge 63 formed outside for connecting a wind pipe 7, which is made of soft aluminum, shaped as bellows, having several support steel-rings 70 fixed on the upper inner wall.

Figure 4:
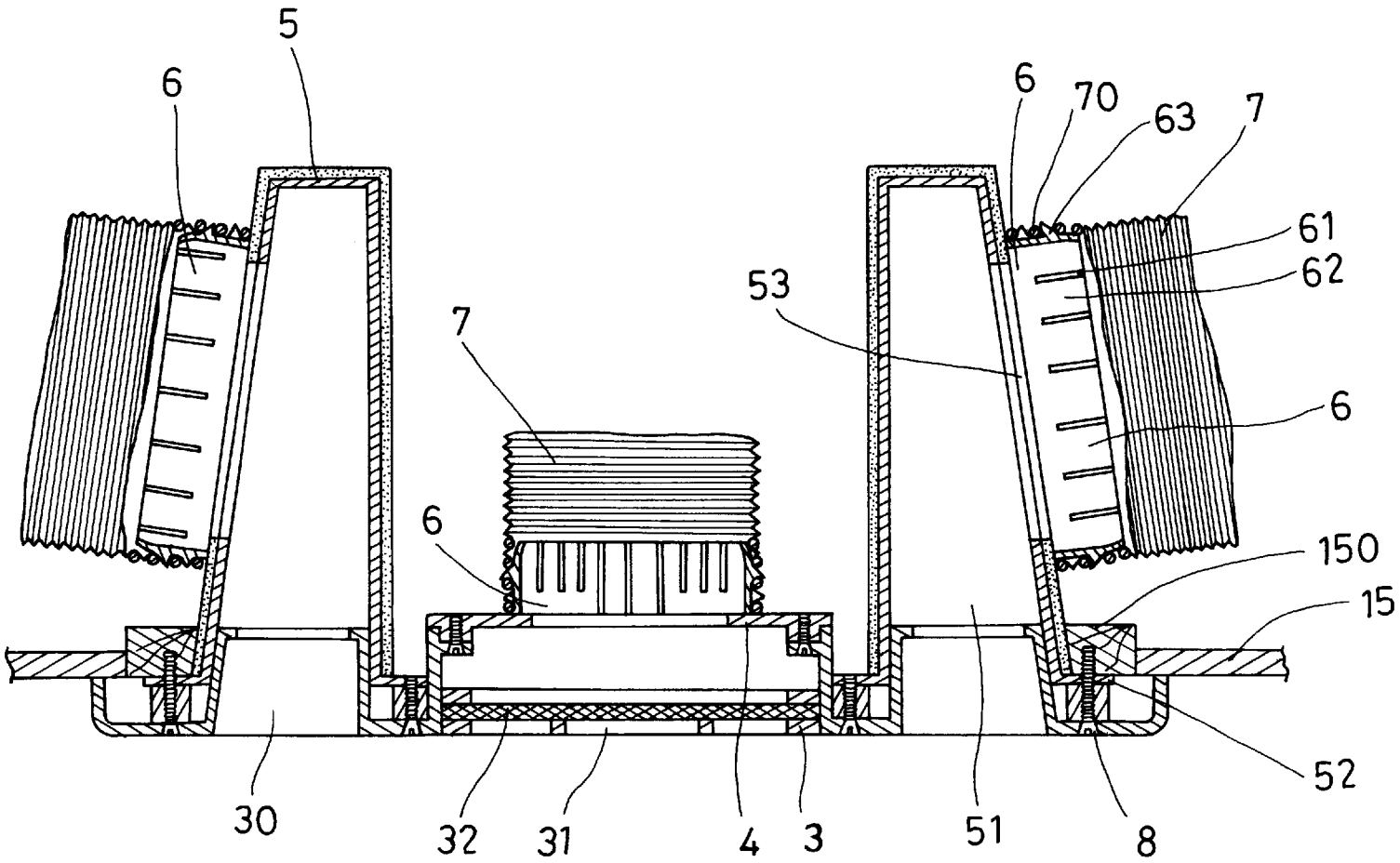
FIG. 4 is a side cross-sectional view of the wind-hole device of a ventilator for an air conditioner in the present invention; and, FIG. 5 is a side cross-sectional view of wind-hole device, showing a condition of wind exhausting and sucking in the present invention.
Figure 5:
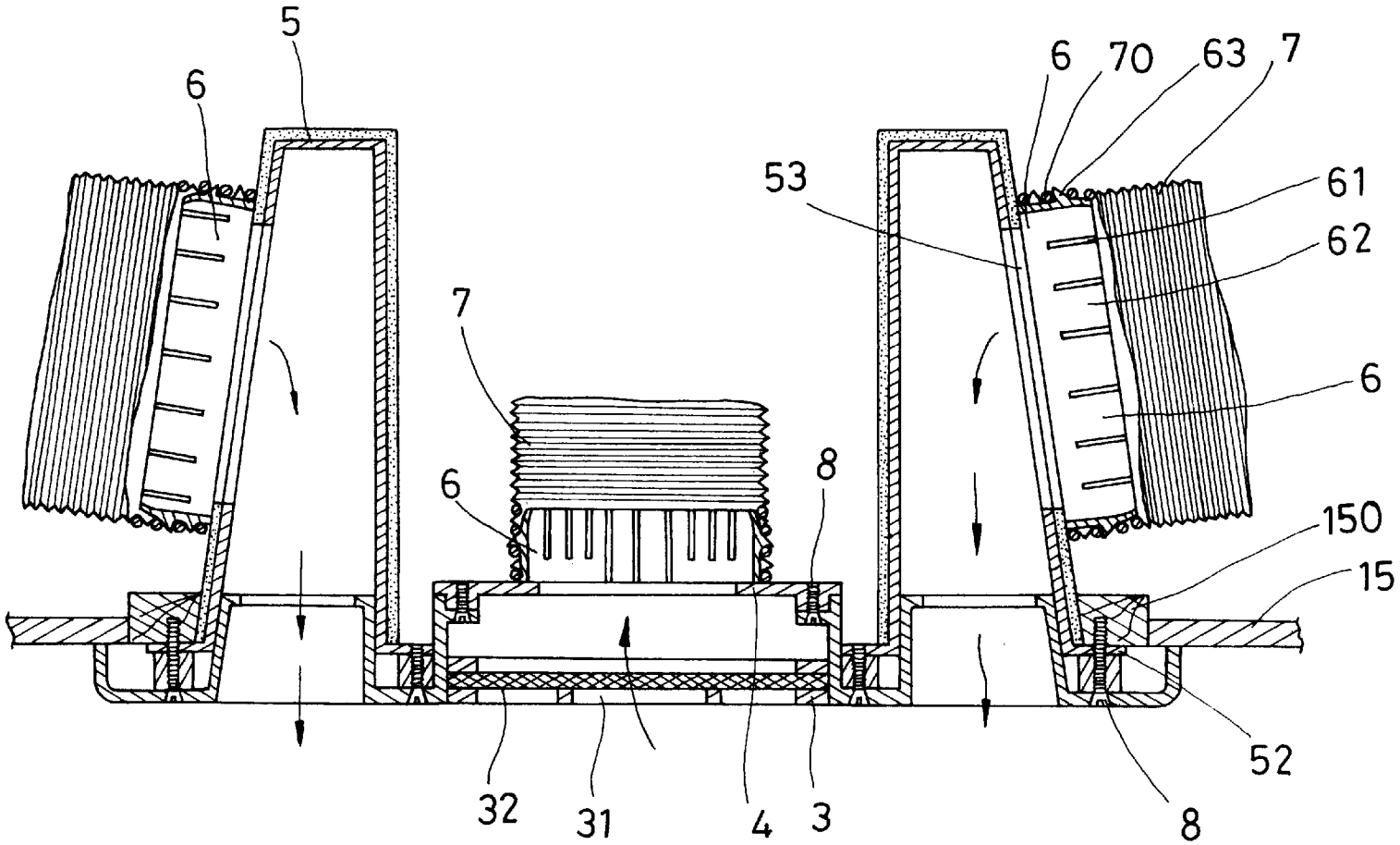

In assembling, as shown in FIGS. 3 and 4, firstly the wind-pipe connecters 6 are respectively connected with the center holes 53 of the shells 5 and the vent-holes 40 of the cover plate 4 by means of screw 8; then wind-pipes 7 are connected with the wind-pipe connecters 6 by making the elastic insertion members 62 shrink inwards for the wind-pipes 7 to fit in and by pushing the sloped insert lateral edges 63 of the elastic inserting members 62 to engage the support steel-ring 70 of the wind-pipes 7. Next, the shells 5 are respectively assembled with the wind outlets 30 of the faceplate 3 by engaging the downward opening 51 with the protruding-up edge of the wind outlet 30, and then the cover plate 4 is fixed on the wind inlet 31 of the faceplate 3 with screw 8. Lastly, the finished windpipe device is fixed with a prefixed connection member 150 on the ceiling by means of screw 8.

The wind-hole device in this invention is characterized by the space in the shells 5 separated to serve as a wind-exhausting chamber and a wind-sucking chamber to facilitate air ventilation.

While the preferred embodiments of the invention have been described above, it will be recognized and understood that various modifications may be made therein, and the appended claims are intended to cover all such modifications that may fall within the spirit and scope of the invention.

What is claimed is:

1. A wind-hole device of a ventilator for an air conditioner comprising:

a faceplate having a plurality of wind-outlets and wind-inlets;

a cover plate fitted on said wind-inlets of said faceplate, the cover plate having a plurality of vent-holes;

a plurality of shells connected with said wind-outlets of said faceplate, respectively having a downward opening and a center hole formed in a center portion thereof;

a plurality of wind-pipe connecters each connected to a respective one of said vent-holes of said cover plate and said center holes of said shells;

said shells assembled on said faceplate to form spaced apart wind-exhausting chambers; and a wind-returning chamber formed between the wind-exhausting chambers, the wind-returning chamber comprising space between the faceplate and the cover plate.

2. The wind-hole device as claimed in claim 1, wherein said shells are surrounded with heat insulating material of a certain thickness.

3. The wind-hole device as claimed in claim 1, wherein said wind-pipe connecters are made integral of plastic material, having a plurality of elastic insert members formed spaced apart by a plurality of vertical slots cut in an oval shaped vertical circumferential wall, an insert flange formed around a lower side of said vertical circumferential wall, said wind pipes respectively made of soft aluminum, shaped as bellows, and having support steel-ring fixed on an upper inner wall engaging with said sloped insert lateral edges of said wind-pipe connecter; each said wind pipe connector is connected quickly and stably with each said wind pipe, by compressing and inserting said elastic insert members in an end of said wind pipe, with said sloped insert lateral edges engaging said support steel-rings of said wind pipe.

* * * * *